US010582294B2

(12) United States Patent
Tu

(10) Patent No.: US 10,582,294 B2
(45) Date of Patent: Mar. 3, 2020

(54) EARPHONE

(71) Applicant: I-Hung Tu, Taipei (TW)

(72) Inventor: I-Hung Tu, Taipei (TW)

( * ) Notice: Subject to any disclaimer, the term of this patent is extended or adjusted under 35 U.S.C. 154(b) by 0 days.

(21) Appl. No.: 16/023,030

(22) Filed: Jun. 29, 2018

(65) Prior Publication Data

US 2019/0020946 A1 Jan. 17, 2019

(30) Foreign Application Priority Data

Jul. 11, 2017 (TW) ..... 106123126 A

(51) Int. Cl.

| | |
|---|---|
| ***H04R 1/28*** | (2006.01) |
| ***H04R 1/10*** | (2006.01) |
| ***H04R 1/34*** | (2006.01) |
| *H04R 1/24* | (2006.01) |

(52) U.S. Cl.

CPC ..... *H04R 1/2857* (2013.01); *H04R 1/1016* (2013.01); *H04R 1/1075* (2013.01); *H04R 1/345* (2013.01); *H04R 1/24* (2013.01)

(58) Field of Classification Search

CPC .. H04R 1/1058; H04R 1/1066; H04R 1/2857; H04R 1/1016; H04R 1/1075; H04R 1/345; H04R 1/24; H04R 1/10; H04R 1/1008; H04R 1/2826; H04R 1/2849

USPC ..... 381/380, 423, 424, 430, 432

See application file for complete search history.

(56) References Cited

U.S. PATENT DOCUMENTS

| | | | | |
|---|---|---|---|---|
| 8,526,659 | B2 * | 9/2013 | Nageno | H04R 11/02 381/380 |
| 9,913,038 | B2 * | 3/2018 | Pan | H04R 1/1075 |
| 2005/0094843 | A1 * | 5/2005 | Soto-Nicolas | H04R 1/225 381/423 |
| 2012/0097475 | A1 | 4/2012 | Schumaier | |
| 2014/0193022 | A1 | 7/2014 | Koizumi | |
| 2014/0205131 | A1 * | 7/2014 | Azmi | H04R 1/1075 381/380 |
| 2015/0023541 | A1 * | 1/2015 | Ho | H04R 1/1058 381/380 |
| 2017/0230741 | A1 * | 8/2017 | Matsuo | H04R 11/02 |
| 2017/0353780 | A1 * | 12/2017 | Huang | H04R 1/10 |
| 2018/0213318 | A1 * | 7/2018 | Wiederholtz | H04R 1/24 |

FOREIGN PATENT DOCUMENTS

| | | |
|---|---|---|
| EP | 2765788 A2 | 8/2014 |
| TW | I535302 B | 5/2016 |

* cited by examiner

*Primary Examiner* — Binh Kien Tieu

(74) *Attorney, Agent, or Firm* — R. Lynette Wylie; Apex Juris, pllc.

(57) ABSTRACT

An earphone includes a housing, a speaker unit arranged in the housing, a sound guiding portion disposed on the housing, and a sound guiding tube disposed in the sound guiding portion such that an inner sound guiding channel and an outer sound guiding channel are formed in the sound guiding portion. The sound guiding portion has a sound output hole of the inner sound guiding channel and a sound output hole of the outer sound guiding channel. The sound output hole of the inner sound guiding channel protrudes from the sound output hole of the outer sound guiding channel. The sound waves in the inner sound guiding channel directly pass through the sound output hole of the inner sound guiding channel, and the sound waves in the outer sound guiding channel directly pass through the sound output hole of the outer sound guiding channel.

4 Claims, 13 Drawing Sheets

EARPHONE

CROSS-REFERENCE TO RELATED PATENT APPLICATION

This application claims the benefit of priority to Taiwan Patent Application No. 106123126, filed on Jul. 11, 2017. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an earphone, and in particular, to an earphone having multiple sound output holes.

BACKGROUND OF THE DISCLOSURE

An earphone is generally configured to be worn on both ears of a user, and is used to be connected with a sound source device. The sound source device is configured to input electrical signals to the earphone, and the earphone is configured to convert the electrical signals into sound waves which can be heard by the user.

Taiwan Patent Publication No. 1535302 discloses an earphone including a housing having at least two sound output holes; and a speaker unit arranged in the housing and having at least two sound generating parts. The sound waves generated by one of the sound generating parts directly pass through one of the sound output holes, and the sound waves generated by the other sound generating part are indirectly outputted from the other sound output holes.

More specifically, the housing includes a chamber formed therein, and the sound output holes include a first sound output hole and a second sound output hole. The first sound output hole faces one of the sound generating parts, a sound barrier wall is formed on a position of the chamber opposite to the other sound generating part, and the sound waves generated by the other sound generating part are refracted by the sound barrier wall, and then directly pass through the second sound output hole.

More specifically, the first sound output hole is located on an end face of the housing, and the second sound output hole is located on a circumferential wall of the housing.

More specifically, the earphone includes an ear hook connected to the housing.

More specifically, the earphone includes an earplug disposed on a front face of the housing, the first sound output hole is located on the earplug, and the second sound output hole is located on a side of the first sound output hole of the earplug.

More specifically, the housing includes a chamber formed therein, and the sound output holes include a first sound output hole and two second sound output holes. The two second sound output holes are located on two opposite sides of the housing such that the three sound output holes have different extending directions toward the outside of the housing. The first sound output hole faces one of the sound generating parts, a sound barrier wall is formed on a position of the chamber opposite to the other sound generating part, and the sound waves generated by the other sound generating part are refracted by the sound barrier wall, and then are respectively outputted from the two second sound output holes.

More specifically, the housing includes a chamber formed therein, the earphone includes an ear tube disposed on the housing, and the sound output holes include a first sound output hole, a second sound output hole, and a third sound output hole. The three sound output holes have different extending directions toward the outside of the housing. The first sound output hole is located at an end of the ear tube, and the second sound output hole and the third sound output hole are located on an outer wall of the ear tube. The ear tube has a sound guiding channel formed therein, an end of the sound guiding channel is in spatial communication with the chamber of the housing, and the other end of the sound guiding channel is located inside a free end of the ear tube, the second sound output hole and the third sound output hole are respectively in spatial communication with the other end of the sound guiding channel, and the first sound output hole is in spatial communication with one of the sound generating parts. The sound guiding channel, the second sound output hole, and the third sound output hole are in spatial communication with the other sound generating part.

More specifically, the sound guiding channel includes a partition wall formed on an inner wall of the other end of the sound guiding channel, two side walls of the partition wall each has a sound guiding inclined surface, two side walls of the other end of the sound guiding channel located at two sides of the partition wall is respectively formed as a sound barrier wall, and the second sound output hole and the third sound output hole respectively face the two sound guiding inclined surfaces of the partition wall.

More specifically, the ear phone includes a sleeve sleeved on the ear tube, the sleeve being an elastic rubber body, and the sleeve having a plurality of openings corresponding to the positions of the first sound output hole, the second sound output hole, and the third sound output hole.

Although the configurations of the earphone described above are capable of providing a stereo sound field effect, the sound outputted from the earphone is not clear because the sound has been refracted to cause a sound loss so that the earphone cannot provide a clear sound and a sound field effect to the user at the same time.

SUMMARY OF THE DISCLOSURE

In view of the drawbacks of the in-ear earphone described in the related art, namely, being unable to provide a clear sound and a sound field effect to the user at the same time, the present disclosure provides an earphone which has inner and outer sound guiding channels, and has front and back sound output holes such that the front sound output hole of the inner sound guiding channel is capable of providing a clear sound, and the back sound output hole of the outer sound guiding channel is capable of providing a sound field effect, thereby achieving the purpose of providing the clear sound and the sound field effect to the user at the same time.

In one aspect, the present disclosure provides an earphone including: a housing; a sound guiding portion disposed on the housing, at least one speaker unit arranged in the housing, and a sound guiding tube disposed in the sound guiding portion such that an inner sound guiding channel and an outer sound guiding channel are formed in the sound guiding portion. The outer sound guiding channel is divided into at least one sound guiding channel. The sound guiding portion has at least one sound output hole of the inner sound guiding channel and at least one sound output hole of the outer sound guiding channel, and all the sound output holes are oriented in the same direction that the sound guiding portion extends. The sound output hole of the inner sound guiding channel protrudes from the sound output hole of the outer sound guiding channel such that the sound output hole of the inner sound guiding channel is farther from the housing than the sound output hole of the outer sound guiding channel. The sound waves in the inner sound guiding channel directly pass through the sound output hole of the inner sound guiding channel, and the sound waves in the outer sound guiding channel directly pass through the sound output hole of the outer sound guiding channel.

In certain embodiments, an outer wall of the sound guiding tube has a ring-shaped inclined surface close to the sound output holes, the inclined surface is in front of the sound output hole of the outer sound guiding channel and is close to the sound output hole of the inner sound guiding channel. The inclined surface covers a part of the sound output direction of the sound output hole of the outer sound guiding channel such that a part of the sound waves outputted from the sound output hole of the outer sound guiding channel are directly outputted, and another part of the sound waves outputted from the sound output hole of the outer sound guiding channel are refracted by the inclined surface.

In one aspect, the present disclosure provides an earphone including: a housing, a first speaker unit, and a second speaker unit; a sound guiding portion disposed on the housing; and at least one sound guiding channel and an accommodating structure capable of accommodating the second speaker unit respectively disposed in the sound guiding portion. The sound guiding channel is located between the accommodating structure and an outer wall of the sound guiding portion, and a sound output hole of the sound guiding channel is located at an end face of the sound guiding portion away from the housing. The accommodating structure partially protrudes from the sound output hole of the sound guiding channel, and a front end of the accommodating structure has a sound output hole. The first speaker unit is arranged in the housing, and the second speaker unit is arranged in the accommodating structure The sound output direction of the second speaker unit is the same as the sound output direction of the sound guiding portion. The sound waves generated by the first speaker unit directly pass through the sound output hole of the sound guiding channel, and the sound waves generated by the second speaker unit directly pass through the sound output hole of the accommodating structure.

In certain embodiments, an outer wall of the accommodating structure has a ring-shaped inclined surface close to the sound output holes, the inclined surface is in front of the sound output hole of the sound guiding channel and is close to the sound output hole of the accommodating structure. The inclined surface covers a part of the sound output direction of the sound output hole of the sound guiding channel such that a part of the sound waves outputted from the sound output hole of the sound guiding channel are directly outputted, and another part of the sound waves outputted from the sound output hole of the sound guiding channel are refracted by the inclined surface.

In one aspect, the present disclosure provides an earphone including: a housing, a first speaker unit, a second speaker unit, a third speaker unit, a fourth speaker unit, and an ear plug sleeve; a tubular sound guiding portion disposed on the housing; and an accommodating structure located at a front end of the sound guiding portion, a front end of the accommodating structure protruding from an end face of the sound guiding portion. The first speaker unit is arranged in the housing, and the second speaker unit is arranged in the accommodating structure located at the front end of the sound guiding portion. The sound output direction of the second speaker unit is the same as the sound output direction of the sound guiding portion; in which an inside of the sound guiding portion includes a left chamber located at a left side of the accommodating structure, and includes a right chamber located at a right side of the accommodating structure. The third speaker unit is arranged in the left chamber, and the fourth speaker unit is arranged in the right chamber. The inside of the sound guiding portion is divided into an upper sound guiding channel and a lower sound guiding channel by the accommodating structure, the left chamber, and the right chamber. The upper sound guiding channel and the lower sound guiding channel each has a sound output hole located at an end face of the sound guiding portion away from the housing; in which a front end of the accommodating structure has a sound output hole, a front end of the left chamber has a sound output hole, and a front end of the right chamber has a sound output hole. The sound waves generated by the first speaker unit are directly and respectively outputted from the sound output holes of the upper sound guiding channel and the lower sound guiding channel, the sound waves generated by the second speaker unit directly pass through the sound output hole of the accommodating structure, the sound waves generated by the third speaker unit directly pass through the sound output hole of the left chamber, and the sound waves generated by the fourth speaker unit directly pass through the sound output hole of the right chamber.

In one aspect, the present disclosure provides an earphone including: a housing, a first speaker unit, a second speaker unit, a third speaker unit, a fourth speaker unit, a fifth speaker unit, and an ear plug sleeve; a tubular sound guiding portion disposed on the housing; and an accommodating structure located at a front end of the sound guiding portion, and a front end of the accommodating structure protruding from an end face of the sound guiding portion. The first speaker unit is arranged in the accommodating structure, the sound output direction of the first speaker unit is the same as the sound output direction of the sound guiding portion; in which an inside of the sound guiding portion includes a left chamber located at a left side of the accommodating structure, a right chamber located at a right side of the accommodating structure, an upper chamber located at an upper side of the accommodating structure, and a lower chamber located at a lower side of the accommodating structure. The second speaker unit is arranged in the left chamber, the third speaker unit is arranged in the right chamber, the fourth speaker unit is arranged in the upper chamber, and the fifth speaker unit is arranged in the lower chamber; in which a front end of the accommodating structure has a sound output hole, a front end of the left chamber has a sound output hole, a front end of the right chamber has a sound output hole, a front end of the upper chamber has a sound output hole, and a front end of the lower chamber has a sound output hole. The sound output hole of the left chamber, the sound output hole of the right chamber, the sound output hole of the upper chamber, and the sound output hole of the lower chamber are located at an end face of the sound guiding portion away from the housing. The sound waves generated by the first speaker unit directly pass through the sound output hole of the accommodating structure, the sound waves generated by the second speaker unit directly pass through the sound output hole of the left chamber, the sound waves generated by the third speaker unit directly pass through the sound output hole of the right chamber, the sound waves generated by the fourth speaker unit directly pass through the sound output hole of the upper chamber, and the sound waves generated by the fifth speaker unit directly pass through the sound output hole of the lower chamber.

Therefore, the present disclosure provides various types of earphones by virtue of a plurality of independent sound guiding channels cooperated with front and back sound output holes. More specifically, the earphone of the present disclosure includes the independent sound guiding channels formed on the housing, and includes at least one speaker unit arranged in the housing, such that the speaker unit is capable of outputting soundwaves through one of the sound guiding channels to provide a clear sound, and outputting the soundwaves through the other sound guiding channels to provide a sound field effect by virtue of the design of the sound output directions of the sound guiding channels, and by virtue of the sound diffusion effect. Accordingly, the earphone of the present disclosure is capable of providing the clear sound and the sound field effect to the user at the same time.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
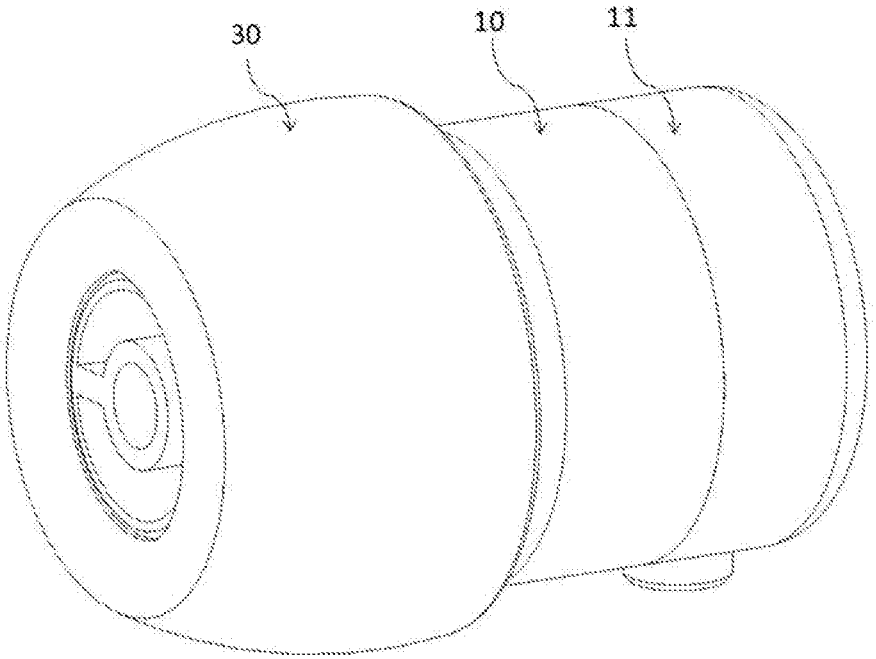
FIG. 1 is a perspective view showing an earphone according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

The present embodiment discloses an earphone. The following describes several preferred embodiments of the present disclosure in conjunction with the accompanying drawings, which further illustrate the technical features taken to achieve the purposes of the present disclosure. The earphone includes two sound generating parts corresponding to two ears of a user, and includes a connecting line used to connect the two sound generating parts and a sound source device. The following first to seventh embodiments are described with one of the two sound generating parts as an example.

Figure 2:
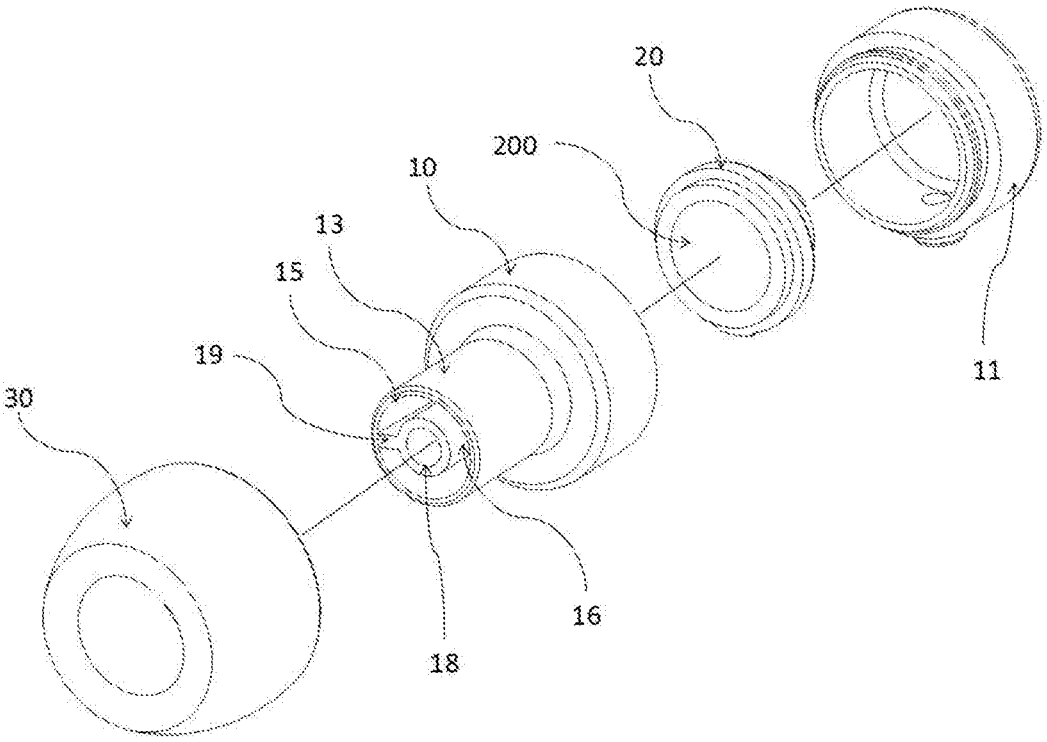
FIG. 2 is an exploded view of FIG. 1.

Referring to FIG. 1 and FIG. 2, which is a first embodiment of the present disclosure, the present embodiment discloses an earplug type earphone including a case, a speaker unit 20, and an ear plug sleeve 30.

Figure 3:
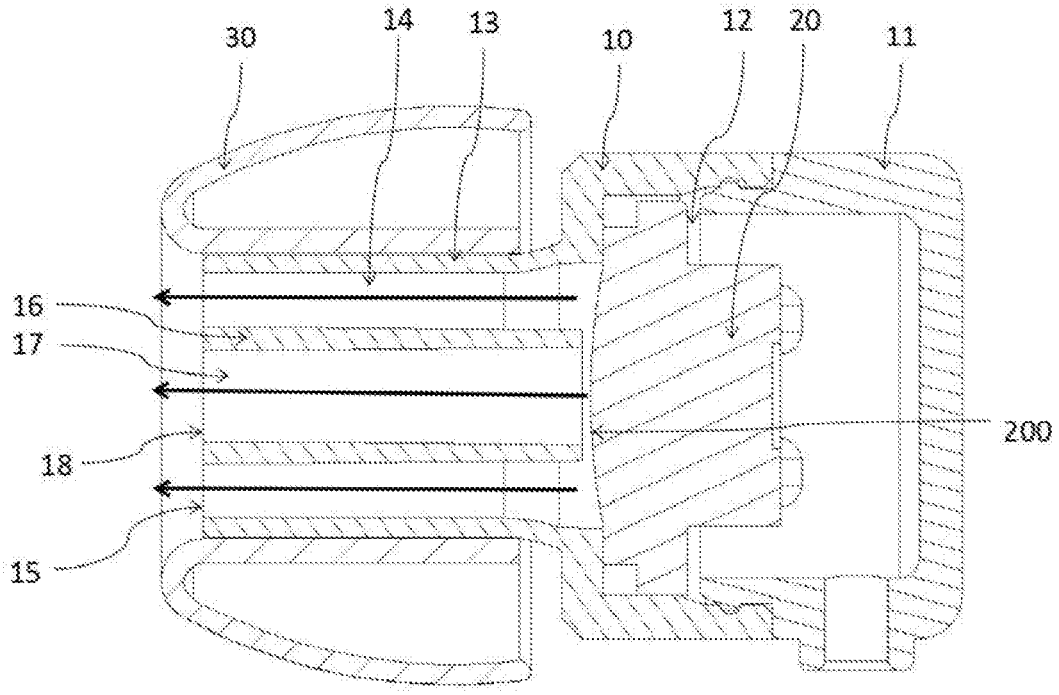
FIG. 3 is a cross-sectional view of FIG. 1.

Referring to FIG. 2 and FIG. 3, the case includes a housing 10 and a cover 11. The housing 10 includes a chamber 12, and a sound guiding portion 13 is disposed on a side face of the housing 10. A sound guiding tube 16 is disposed in the sound guiding portion 13 such that an inner sound guiding channel 17 and an outer sound guiding channel 14 are formed in the sound guiding portion 13. The inner sound guiding channel 17 is located in the sound guiding tube 16, and the outer sound guiding channel 14 is located between the sound guiding portion 13 and the sound guiding tube 16. The sound guiding tube 16 is connected to an outer wall of the sound guiding portion 13 via a connecting portion 19. The inner sound guiding channel 17 has a sound output hole 18 of, and the outer sound guiding channel 14 has a sound output hole 15. The sound output hole 18 of the inner sound guiding channel 17 and the sound output hole 15 of the outer sound guiding channel 14 of the sound guiding portion 13 are located at an end face of the sound guiding portion 13 away from the housing 10. The sound output directions of the sound output hole 15 and the sound output hole 18 toward the direction that the sound guiding portion 13 extends.

The speaker unit 20 is a dynamic speaker unit which has a sound outputting portion 200. The speaker unit 20 is arranged in the chamber 12 of the housing 10, and the sound outputting portion 200 is oriented towards the sound guiding portion 13.

The ear plug sleeve 30 is sleeved on the sound guiding portion 13, and the ear plug sleeve 30 is an elastic rubber body.

According to the first embodiment, in use, the front end of the housing 10 is disposed at the outer ear of the user and is oriented towards the ear canal of the user. The sound output hole 18 of the inner sound guiding channel 17 is oriented directly towards the ear canal, and the sound output hole 15 of the outer sound guiding channel 14 is also oriented towards the ear canal. The sound waves generated by the outer ring region of the sound outputting portion 200 of the speaker unit 20 are transmitted to the inside of the ear of the user through the sound output hole 15 of the outer sound guiding channel 14. The sound waves generated by the inner ring region of the sound outputting portion 200 of the speaker unit 20 directly pass through the sound output hole 18 of the inner sound guiding channel 17. Generally, the sound waves generated by the inner ring region of the sound outputting portion of the dynamic speaker unit are high frequency, and the sound waves generated by the outer ring region of the sound outputting portion of the dynamic speaker unit are low frequency. Since the high frequency sound waves and the low frequency sound waves are not mixed in the sound guiding portion and the high frequency sound waves are sounded closer to the interior of the ear of the user, the earphone of the present embodiment provides a clearer auditory experience than a general in-ear earphone.

Figure 4:
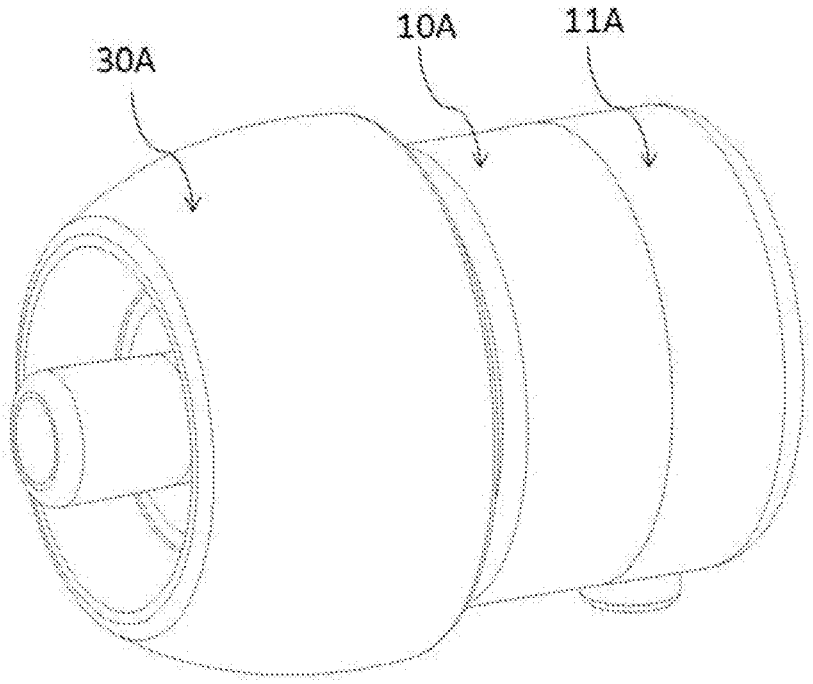
FIG. 4 is a perspective view showing an earphone according to a second embodiment of the present disclosure.
Figure 5:
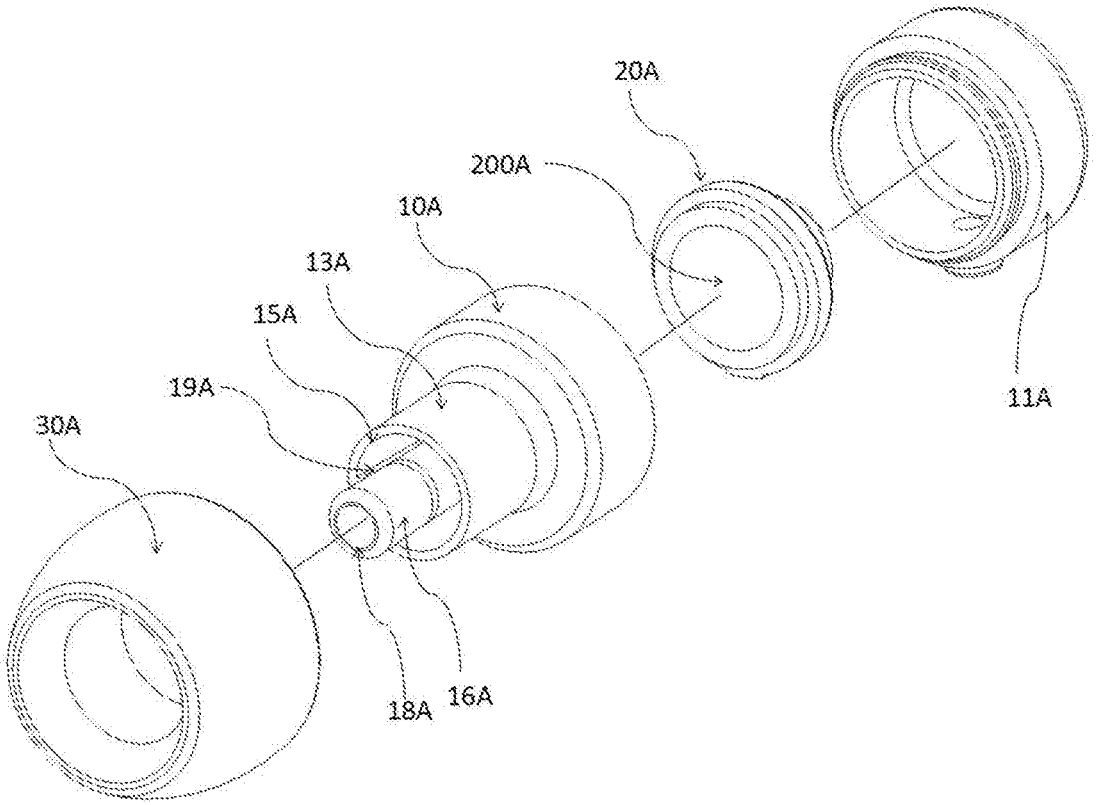
FIG. 5 is an exploded view of FIG. 4.

Referring to FIG. 4 and FIG. 5, which is a second embodiment of the present disclosure, the present embodiment discloses an earplug type earphone including a case, a speaker unit 20A, and an ear plug sleeve 30A.

Figure 6:
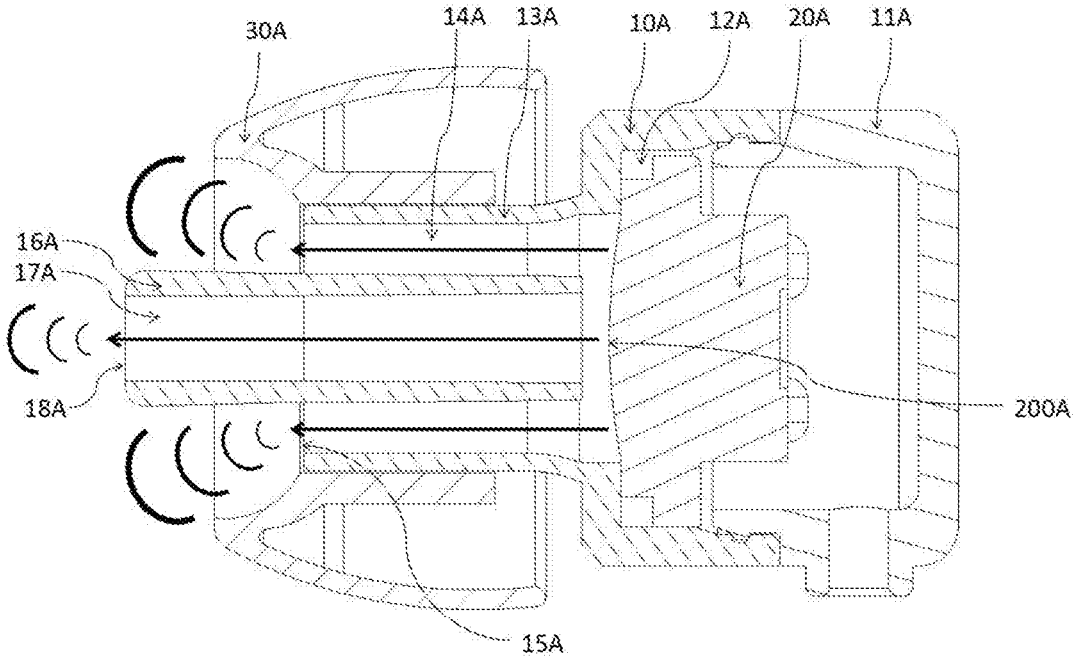
FIG. 6 is a cross-sectional view of FIG. 4.

Referring to FIG. 5 and FIG. 6, the case includes a housing 10A and a cover 11A. The housing 10A includes a chamber 12A, and a sound guiding portion 13A is disposed on a side face of the housing 10A. A sound guiding tube 16A is disposed in the sound guiding portion 13A such that an inner sound guiding channel 17A and an outer sound guiding channel 14A are formed in the sound guiding portion 13A. A front end of the sound guiding tube 16A protrudes from an end face of the sound guiding portion 13A. The inner sound guiding channel 17A is located in the sound guiding tube 16A, and the outer sound guiding channel 14A is located between the sound guiding portion 13A and the sound guiding tube 16A. The sound guiding tube 16A is connected to an outer wall of the sound guiding portion 13A via a connecting portion 19A. The front end of the sound guiding tube 16A has a sound output hole 18A, and the outer sound guiding channel 14A has a sound output hole 15A. The sound output of the sound output hole 15A and the sound output hole 18A is directed toward the direction that the sound guiding portion 13A extends.

The speaker unit 20A is a dynamic speaker unit which has a sound outputting portion 200A. The speaker unit 20A is arranged in the chamber 12A of the housing 10A, and the sound outputting portion 200A is oriented towards the sound guiding portion 13A.

The ear plug sleeve 30A is sleeved on the sound guiding portion 13A, and the ear plug sleeve 30A is an elastic rubber body.

According to the second embodiment, in use, the front end of the housing 10A is disposed at the outer ear of the user and is oriented towards the ear canal of the user. The sound output hole 18A of the inner sound guiding channel 17A is oriented directly towards the ear canal, and the sound output hole 15A of the outer sound guiding channel 14A is also oriented towards the ear canal. The sound waves generated by the sound outputting portion 200A of the speaker unit 20A are transmitted to the inside of the ear of the user through the outer sound guiding channel 14A and the inner sound guiding channel 17A. The sound waves in the inner sound guiding channel 17A directly pass through the sound output hole 18A of the inner sound guiding channel 17A, and the sound waves in the outer sound guiding channel 14A directly pass through the sound output hole 15A of the outer sound guiding channel 14A. Since the sound output hole 18A of the inner sound guiding channel 17A is farther from the housing 10 than the sound output hole 15A of the outer sound guiding channel 14A (i.e. the sound output hole 18A is closer to the ear canal of the user than the sound output hole 15A), the earphone of the present embodiment enables the user to hear a clear sound. Moreover, the sound waves outputted from the sound output hole 15A of the outer sound guiding channel 14A are diffused to create a sound field. In combination with the above two kinds of sounds, the earphone of the present embodiment provides a clearer auditory experience and the sound field effect to the user at the same time.

Figure 7:
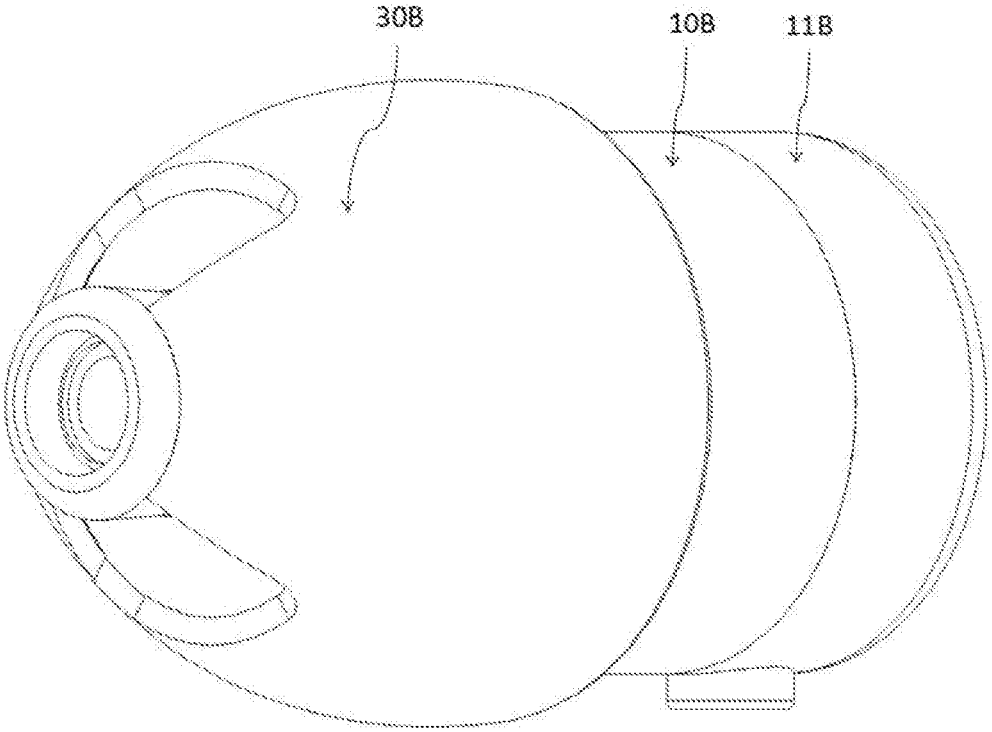
FIG. 7 is a perspective view showing an earphone according to a third embodiment of the present disclosure.
Figure 8:
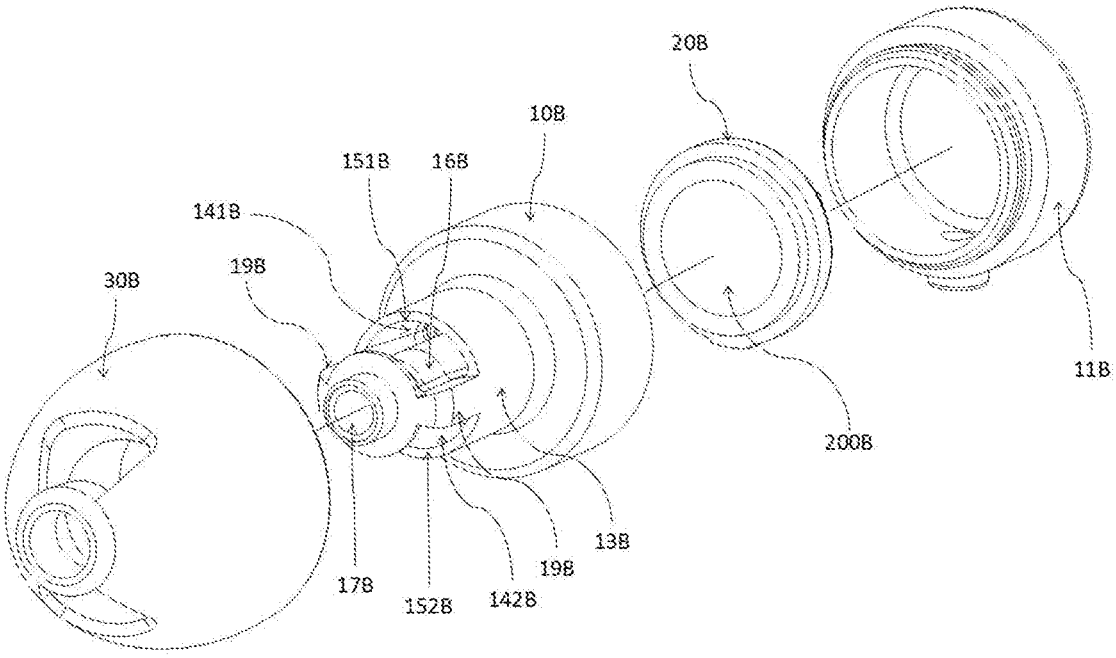
FIG. 8 is an exploded view of FIG. 7.

Referring to FIG. 7 and FIG. 8, which is a third embodiment of the present disclosure, the present embodiment discloses an earplug type earphone including a case, a speaker unit 20B, and an ear plug sleeve 30B.

Figure 9:
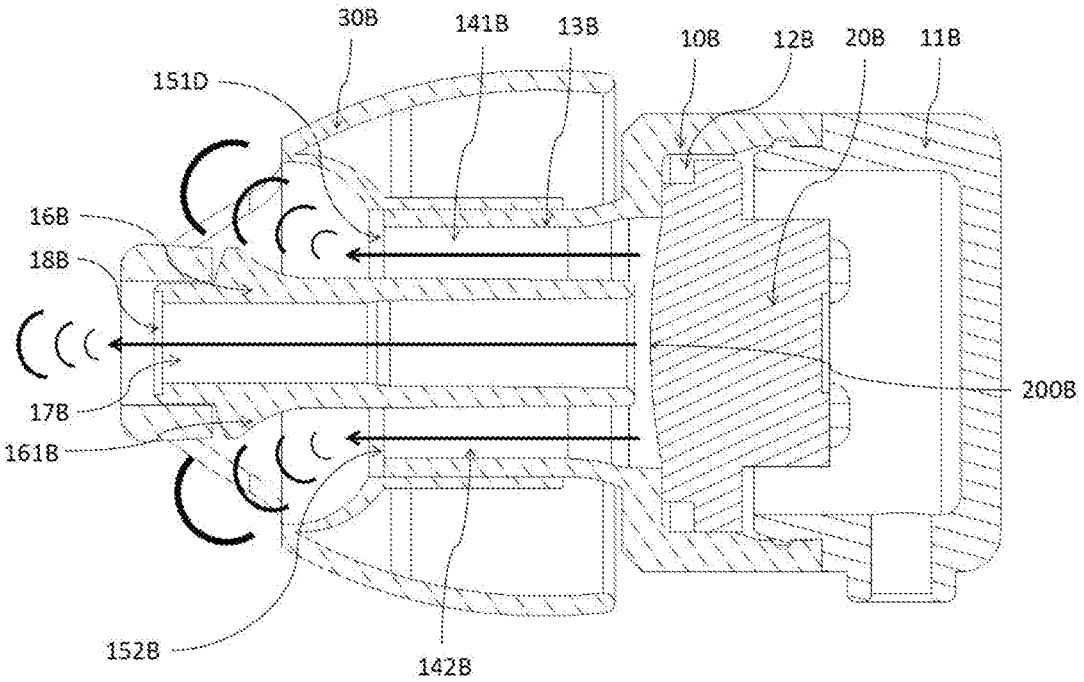
FIG. 9 is a cross-sectional view of FIG. 7.

Referring to FIG. 8 and FIG. 9, the case includes a housing 10B and a cover 11B. The housing 10B includes a chamber 12B, and a sound guiding portion 13B is disposed on a side face of the housing 10B. A sound guiding tube 16B is disposed in the sound guiding portion 13B, and two sides of the sound guiding tube 16B are connected to an outer wall of the sound guiding portion 13B via a connecting portion 19B such that an upper sound guiding channel 141B and a lower sound guiding channel 142B are formed in the sound guiding portion 13B and are located between the outer wall the sound guiding portion 13B and the sound guiding tube 16B. Moreover, an inner sound guiding channel 17B is formed in the sound guiding portion 13B and is located in the sound guiding tube 16B. A front end of the sound guiding tube 16B has a sound output hole 18B. The outer wall of the sound guiding tube 16B has a ring-shaped inclined surface 161B close to the sound output hole 18B. A front end of the upper sound guiding channel 141B has a sound output hole 151B, and a front end of the lower sound guiding channel 142B has a sound output hole 152B. The sound output hole 18B, the sound output hole 151B, and the sound output hole 152B are located at an end face of the sound guiding portion 13B away from the housing 10. The sound output of the sound output hole 18B, the sound output hole 151B, and the sound output hole 152B are directed toward the direction that the sound guiding portion 13B extends. The front end of the sound guiding tube 16B protrudes from the front end of the sound guiding portion 13B such that the sound output hole 18B of the sound guiding tube 16B is farther from the housing 10B than the sound output hole 151B of the upper sound guiding channel 141B and the sound output hole 152B of the lower sound guiding channel 142B.

The speaker unit 20B is a dynamic speaker unit which has a sound outputting portion 200B. The speaker unit 20 is arranged in the chamber 12B of the housing 10B, and the sound outputting portion 200B is oriented towards the sound guiding portion 13B.

The ear plug sleeve 30B is sleeved on the sound guiding portion 13B, and the ear plug sleeve 30B is an elastic rubber body. The ear plug sleeve 30B has a plurality of openings (not labeled) corresponding to the positions of the sound output hole 151B, the sound output hole 152B, and the sound output hole 18B.

According to the third embodiment, in use, the front end of the housing 10B is disposed at the outer ear of the user and is oriented towards the ear canal of the user. The sound output hole 18B of the inner sound guiding channel 17B is oriented directly towards the ear canal, and the sound output hole 151B of the upper sound guiding channel 141B and the sound output hole 152B of the lower sound guiding channel 142B are also oriented toward the ear canal. The sound waves generated by the sound outputting portion 200B of the speaker unit 20B are transmitted to the inside of the ear of the user through the sound guiding portion 13B. The sound waves in the inner sound guiding channel 17B directly pass through the sound output hole 18B of the inner sound guiding channel 17B, the sound waves in the upper sound guiding channel 141B directly pass through the sound output hole 151B of the upper sound guiding channel 141B, and the sound waves in the lower sound guiding channel 142B directly pass through the sound output hole 152B of the lower sound guiding channel 142B. Since the sound output hole 18B is closer to the ear canal of the user than the sound output holes 151B and 152B, the earphone of the present embodiment enables the user to hear a clear sound. Moreover, the sound waves outputted from the sound output holes 151B and 152B are refracted and diffused by the inclined surface 161B to create a multi-channel sound field. In combination with the above two kinds of sounds, the earphone of the present embodiment provides a clearer auditory experience and the multi-channel sound field effect to the user at the same time.

Figure 10:
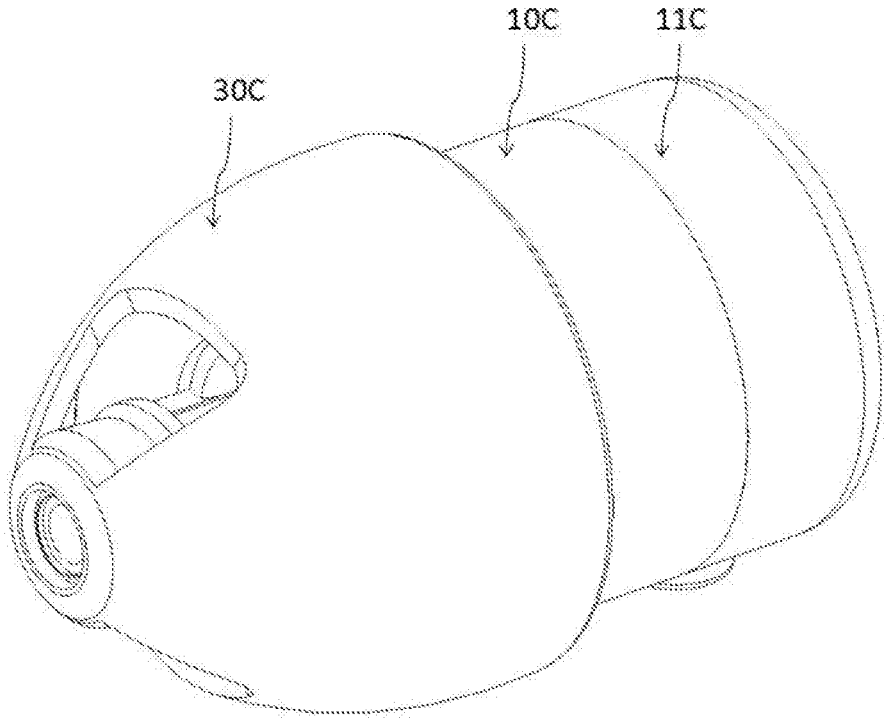
FIG. 10 is a perspective view showing an earphone according to a fourth embodiment of the present disclosure.
Figure 11:
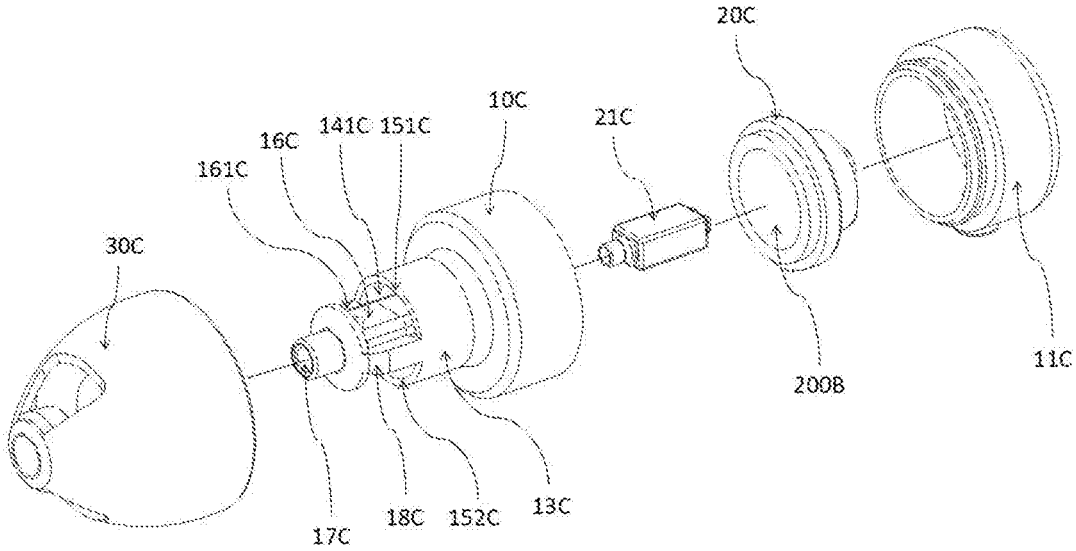
FIG. 11 is an exploded view of FIG. 10.

Referring to FIG. 10 and FIG. 11, which is a fourth embodiment of the present disclosure, the present embodiment discloses an earplug type earphone including a case, a first speaker unit 20C, a second speaker unit 21C, and an ear plug sleeve 30C.

Figure 12:
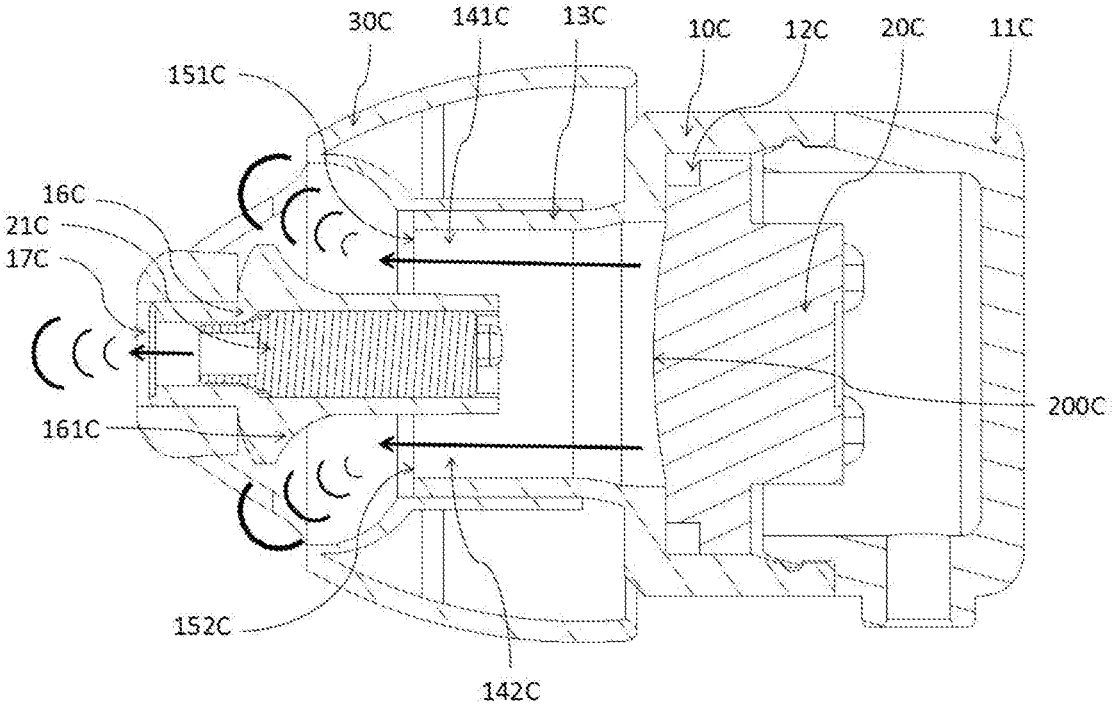
FIG. 12 is a cross-sectional view of FIG. 10.

Referring to FIG. 11 and FIG. 12, the case includes a housing 10C and a cover 11C. The housing 10C includes a chamber 12C, and a sound guiding portion 13C is disposed on a side face of the housing 10C. An accommodating structure 16C is disposed at a front end of the sound guiding portion 13C. The first speaker unit 20C is arranged in the chamber 12C of the housing 10C, and a sound outputting portion 200C of the first speaker unit 20C is oriented towards the sound guiding portion 13C. The second speaker unit 21C is arranged in the accommodating structure 16C which is in front of the sound guiding portion 13C. The sound output direction of the second speaker unit 21C is the same as the sound output direction of the sound guiding portion 13C.

The accommodating structure 16C is connected to an outer wall of the sound guiding portion 13C via a connecting portion 18C such that the inside of the sound guiding portion 13C is divided into an upper sound guiding channel 141C and a lower sound guiding channel 142C. The upper sound guiding channel 141C and the lower sound guiding channel 142C are respectively located at two opposite sides of the accommodating structure 16C. The upper sound guiding channel 141C has a sound output hole 151C, the lower sound guiding channel 142C has a sound output hole 152C, and the sound output holes 151C and 152C are located at an end face of the sound guiding portion 13C away from the housing 10C. The accommodating structure 16C partially protrudes from the sound guiding portion 13C. A front end of the accommodating structure 16C has a sound output hole 17C. An outer wall of the accommodating structure 16C has a ring-shaped inclined surface 161C close to the sound output hole 17C. The inclined surface 161C covers only a part of the sound output direction of the sound output holes 151C and 152C. The sound waves generated by the first speaker unit 20C directly and respectively pass through the sound output hole 151C of the upper sound guiding channel 141C and the sound output hole 152C of the lower sound guiding channel 142C, and then the sound waves are refracted and diffused by the inclined surface 161C of the outer wall of the accommodating structure 16C such that the sound waves are transmitted to the inside of the ear of the user. The sound waves generated by the second speaker unit 21C are directly transmitted to the inside of the ear of the user through the sound output hole 17C of the accommodating structure 16C.

The ear plug sleeve 30C is sleeved on the sound guiding portion 13C, and the ear plug sleeve 30C is an elastic rubber body.

The first speaker unit 20C is a dynamic speaker unit, and the second speaker unit 21C is a balanced armature speaker unit.

According to the fourth embodiment, in use, the front end of the housing 10C is disposed at the outer ear of the user and is oriented towards the ear canal of the user. The sound output hole 17C of the accommodating structure 16C is oriented directly towards the ear canal, and the sound output hole 151C of the upper sound guiding channel 141C and the sound output hole 152C of the lower sound guiding channel 142C are also oriented toward the ear canal. The sound waves generated by the first speaker unit 20C directly pass through the sound output hole 151C of the upper sound guiding channel 141C and the sound output hole 152C of the lower sound guiding channel 142C, and then the sound waves are refracted and diffused by the inclined surface 161C of the outer wall of the accommodating structure 16C such that the sound waves are transmitted to the inside of the ear of the user. The sound waves generated by the second speaker unit 21C are directly transmitted to the inside of the ear of the user through the sound output hole 17C of the accommodating structure 16C. Since the sound output hole 17C is closer to the ear canal of the user than the sound output holes 151C and 152C, the earphone of the present embodiment enables the user to hear a clear sound. Moreover, the sound waves outputted from the sound output holes 151C and 152C are refracted and diffused by the inclined surface 161C to create a multi-channel sound field. In combination with the above two kinds of sounds, the earphone of the present embodiment provides a clearer auditory experience and the multi-channel sound field effect to the user at the same time.

Figure 13:
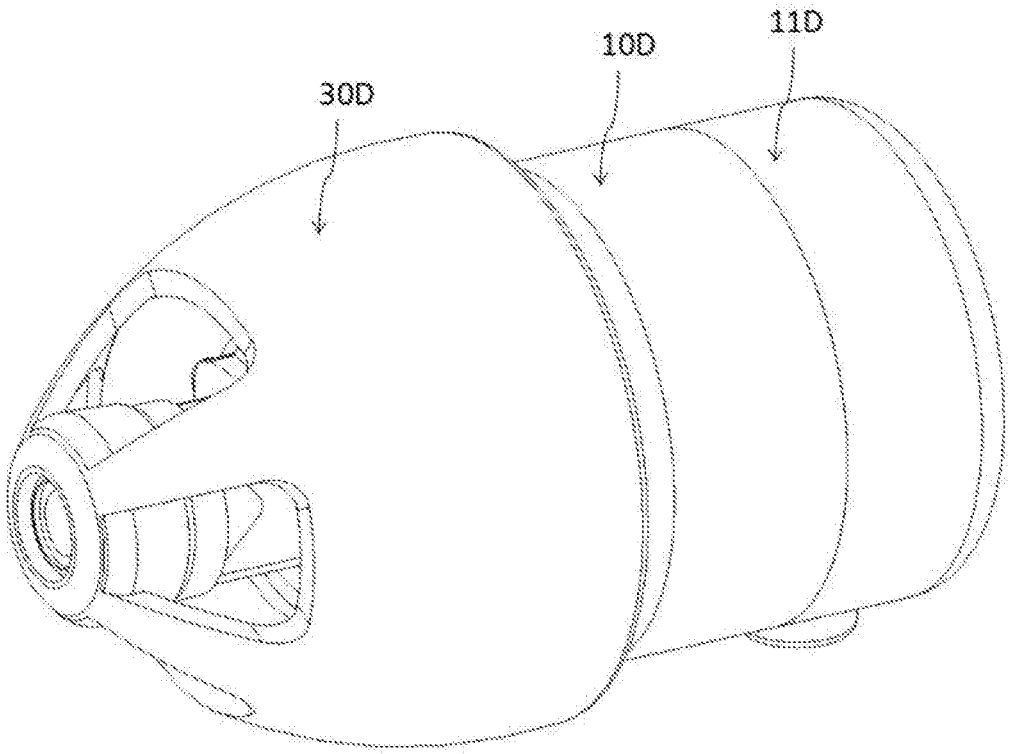
FIG. 13 is a perspective view showing an earphone according to a fifth embodiment of the present disclosure.
Figure 14:
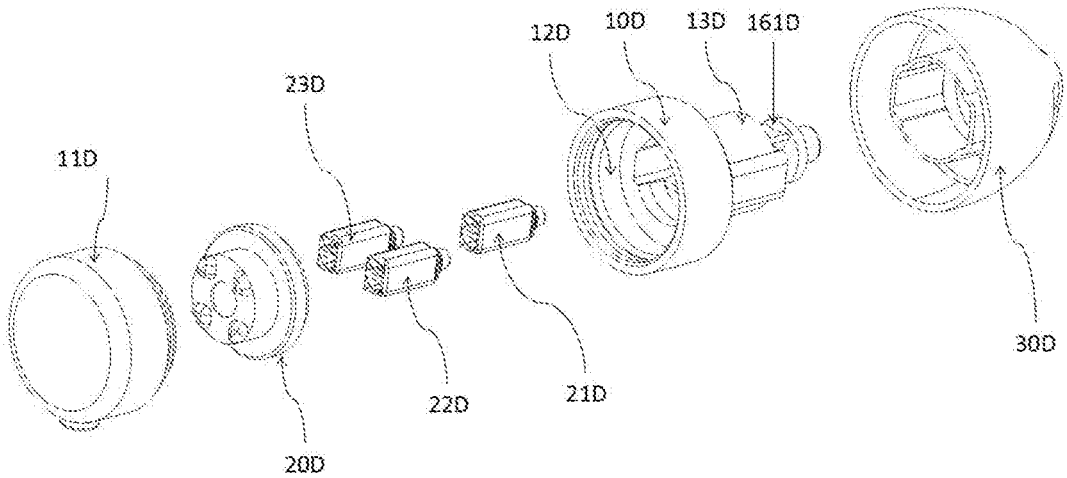
FIG. 14 is an exploded view of FIG. 13.
Figure 15:
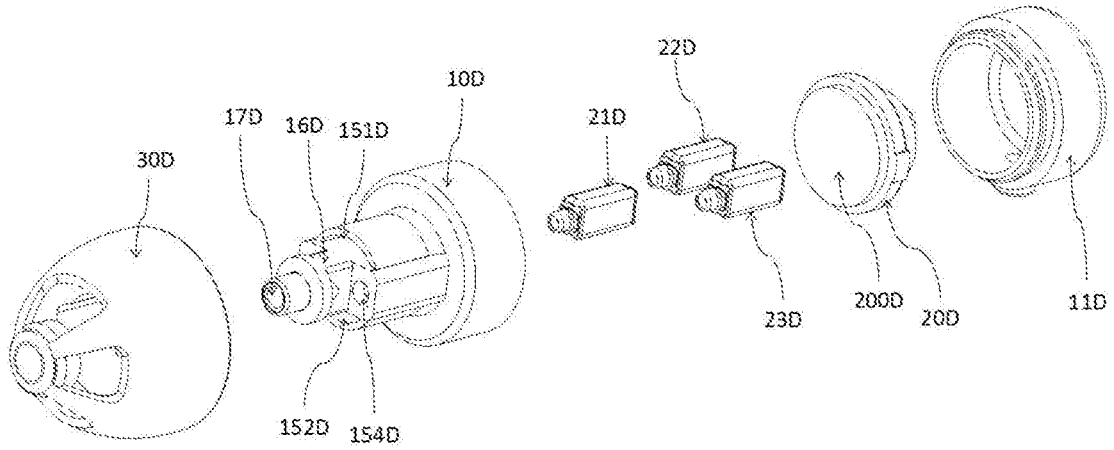
FIG. 15 is an exploded view of FIG. 13 from another viewing angle.
Figure 16:
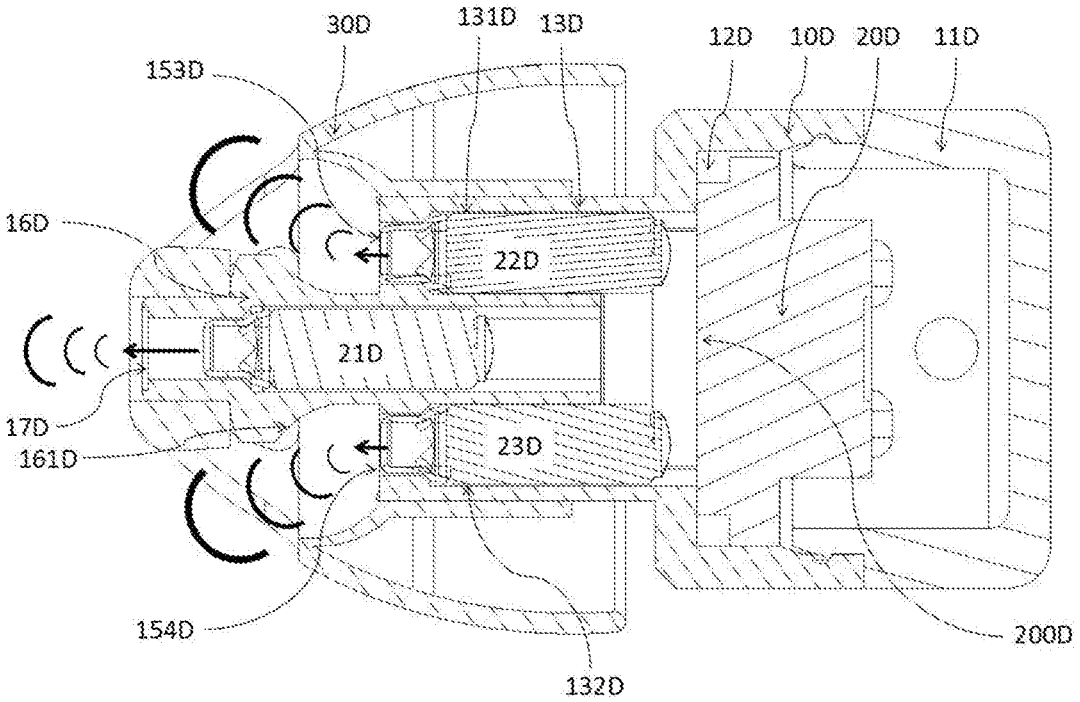
FIG. 16 is a horizontal cross-sectional view of FIG. 13.
Figure 17:
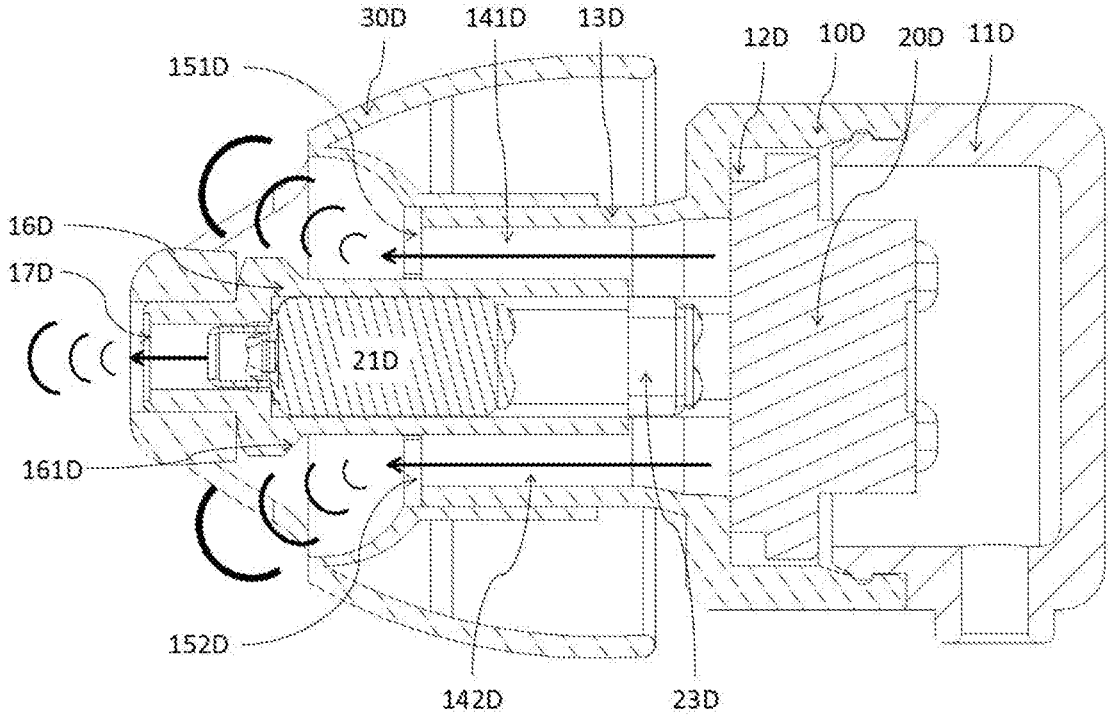
FIG. 17 is a longitudinal cross-sectional view of FIG. 13.

Referring to FIGS. 13 to 15, which is a fifth embodiment of the present disclosure, the present embodiment discloses an earplug type earphone including a case, a first speaker unit 20D, a second speaker unit 21D, a third speaker unit 22D, a fourth speaker unit 23D, and an ear plug sleeve 30D.

Referring to FIGS. 14 to 17, the case includes a housing 10D and a cover 11D. The housing 10D includes a chamber 12D, and a sound guiding portion 13D is disposed on a side face of the housing 10D. An accommodating structure 16D is disposed at a middle portion of an inside of the sound guiding portion 13D. A front end of the accommodating structure 16D protrudes from an end face of the sound guiding portion 13D. The inside of the sound guiding portion 13D includes a left chamber 131D located at a left side of the accommodating structure 16D, and a right chamber 132D located at a right side of the accommodating structure 16D. The first speaker 20D is disposed in the chamber 12D of the housing 10D, and a sound outputting portion 200D of the first speaker unit 20D is oriented towards the sound guiding portion 13D. The second speaker unit 21D is arranged in the accommodating structure 16D which is in front of the sound guiding portion 13D. The sound output direction of the second speaker unit 21D is the same as the sound output direction of the sound guiding portion 13D. The third speaker unit 22D is arranged in the left chamber 131D, and the fourth speaker unit 23D is arranged in the right chamber 132D.

The inside of the sound guiding portion 13D is divided into an upper sound guiding channel 141D and a lower sound guiding channel 142D by the accommodating structure 16D, the left chamber 131D, and the right chamber 132D. The accommodating structure 16D has a sound output hole 17D, the upper sound guiding channel 141D has a sound output hole 151D, the lower sound guiding channel 142D has a sound output hole 152D, and the sound output holes 151D and 152D are located at an end face of the sound guiding portion 13D away from the housing 10D. A front end of the left chamber 131D has a sound output hole 153D, and a front end of the right chamber 132D has a sound output hole 154D. An outer wall of the accommodating structure 16D has a ring-shaped inclined surface 161D close to the sound output hole 17D. The sound waves generated by the first speaker unit 20D are directly and respectively outputted from the sound output hole 151D of the upper sound guiding channel 141D and the sound output hole 152D of the lower sound guiding channel 142D. The sound waves generated by the second speaker unit 21D directly pass through the sound output hole 17D of the accommodating structure 16D. The sound waves generated by the third speaker unit 22D directly pass through the sound output hole 153D of the left chamber 131D. The sound waves generated by the fourth speaker unit 23D directly pass through the sound output hole 154D of the right chamber 132D.

The ear plug sleeve 30D is sleeved on the sound guiding portion 13D, and the ear plug sleeve 30D is an elastic rubber body. The ear plug sleeve 30D has a plurality of openings (not labeled) corresponding to the positions of the sound output hole 151D, the sound output hole 152D, the sound output hole 153D, the sound output hole 154D, and the sound output hole 17D.

The first speaker unit 20D is a dynamic speaker unit. The second speaker unit 21D, the third speaker unit 22D, and the fourth speaker unit 23D are balanced armature speaker units.

According to the fifth embodiment, in use, the front end of the housing 10D is disposed at the outer ear of the user and is oriented towards the ear canal of the user. The sound output hole 17D of the accommodating structure 16D is oriented directly towards the ear canal, and the sound output holes 151D, 152D, 153D, and 154D are also oriented toward the ear canal. The sound waves generated by the first speaker unit 20D directly pass through the sound output hole 151D of the upper sound guiding channel 141D and the sound output hole 152D of the lower sound guiding channel 142D. The sound waves generated by the third speaker unit 22D directly pass through the sound output hole 153D, and the sound waves generated by the fourth speaker unit 23D directly pass through the sound output hole 154D. The sound waves generated by the sound output holes 151D, 152D, 153D, and 154D are refracted and diffused by the inclined surface 161D of the outer wall of the accommodating structure 16D such that the sound waves are transmitted to the inside of the ear of the user. The sound waves generated by the second speaker unit 21D are directly transmitted to the inside of the ear of the user through the sound output hole 17D of the accommodating structure 16D. Since the sound output hole 17D is closer to the ear canal of the user than the sound output holes 151D, 152D, 153D, and 154D, the earphone of the present embodiment enables the user to hear a clear sound. Moreover, the sound waves outputted from the sound output holes 151D, 152D, 153D, and 154D are refracted and diffused by the inclined surface 161D to create a multi-channel sound field. In combination with the above two kinds of sounds, the earphone of the present embodiment provides a clearer auditory experience and the multi-channel sound field effect to the user at the same time.

Figure 18:
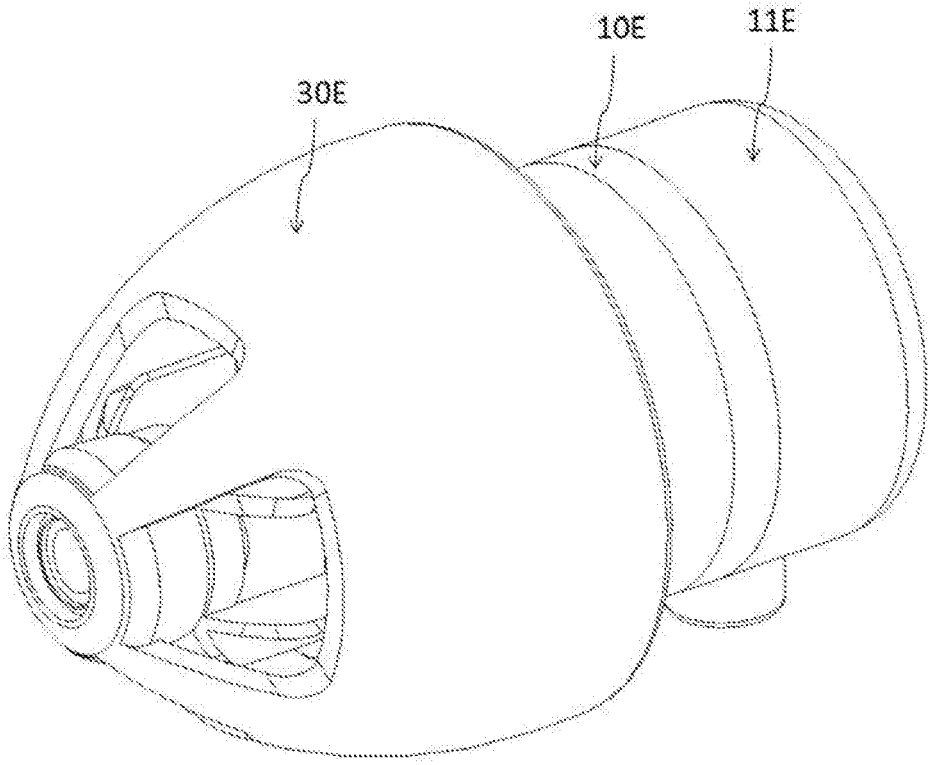
FIG. 18 is a perspective view showing an earphone according to a sixth embodiment of the present disclosure.
Figure 19:
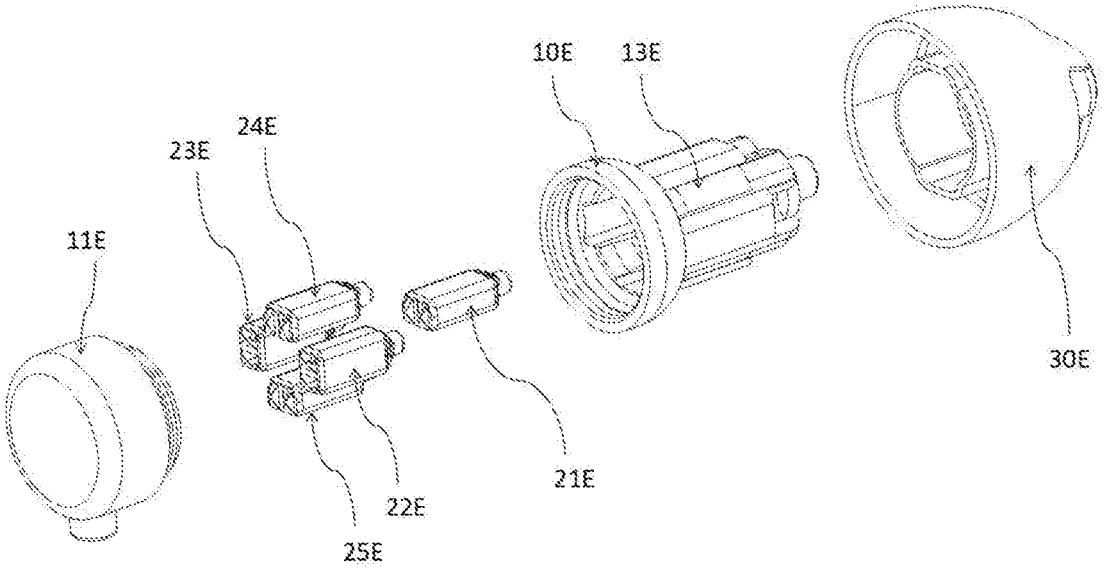
FIG. 19 is an exploded view of FIG. 18.
Figure 20:
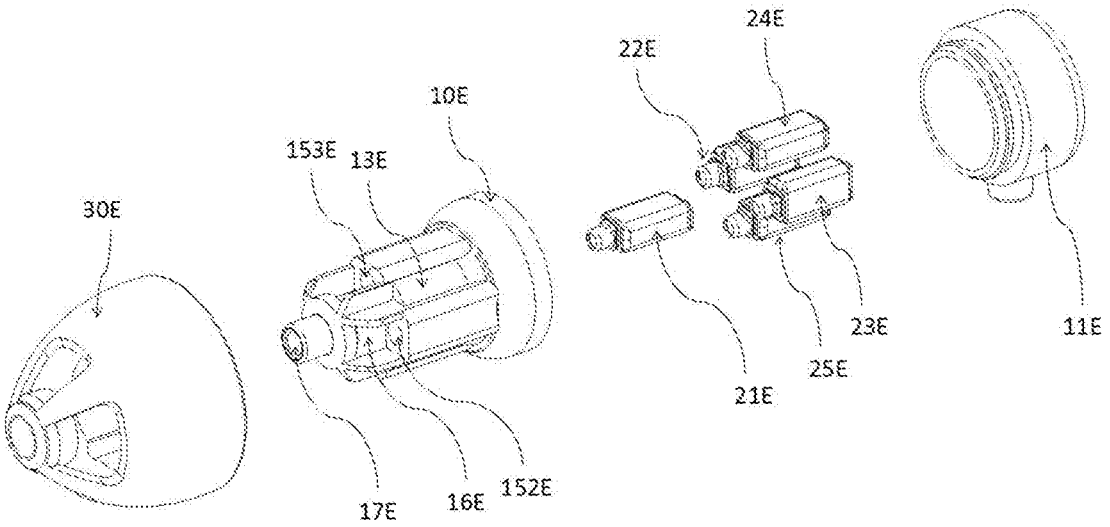
FIG. 20 is an exploded view of FIG. 18 from another viewing angle.
Figure 21:
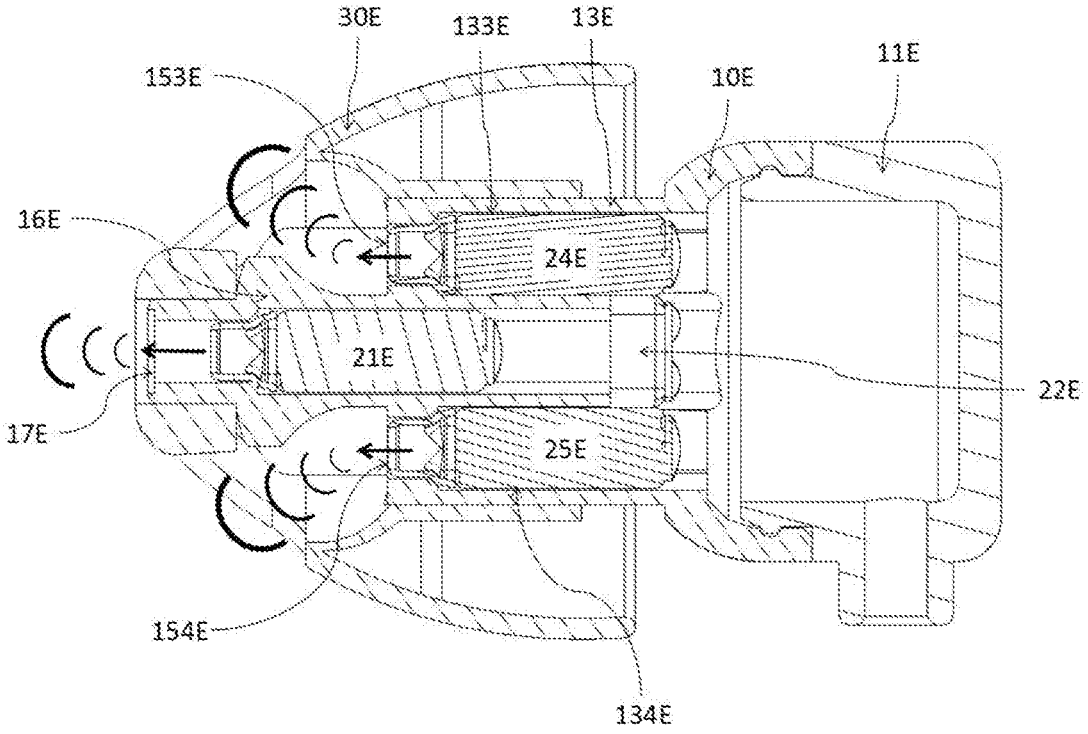
FIG. 21 is a horizontal cross-sectional view of FIG. 18.
Figure 22:
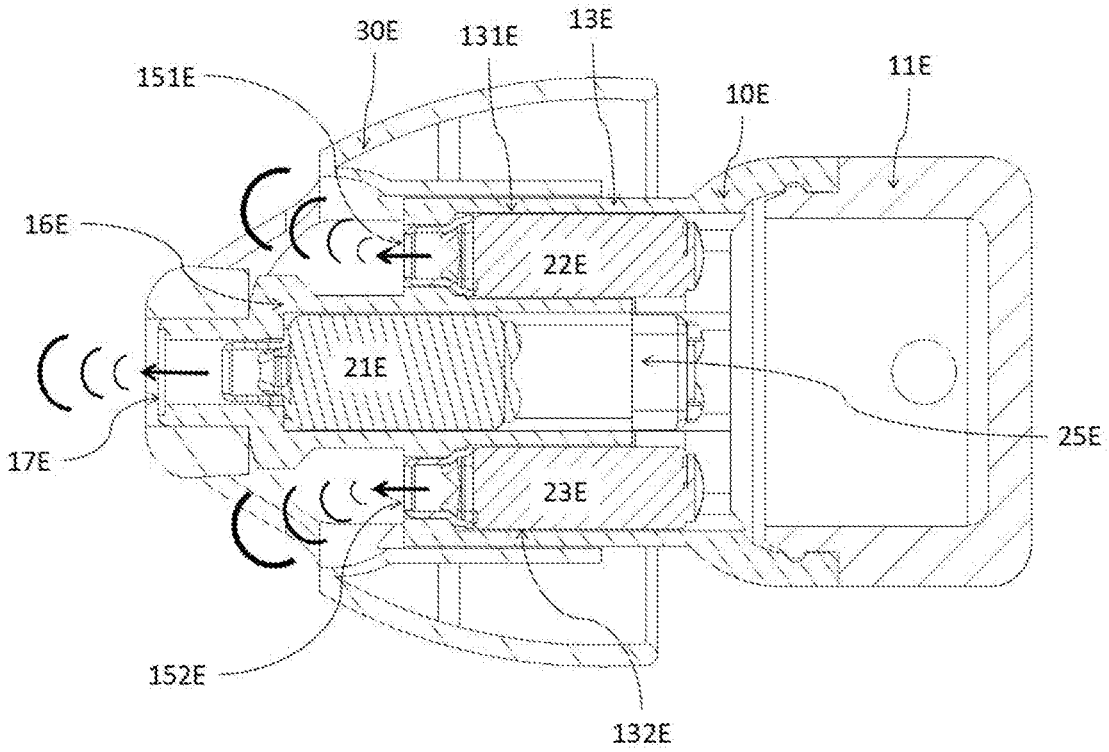
FIG. 22 is a longitudinal cross-sectional view of FIG. 18.

Referring to FIGS. 18 to 20, which is a sixth embodiment of the present disclosure, the present embodiment discloses an earplug type earphone including a case, a first speaker unit 21E, a second speaker unit 22E, a third speaker unit 23E, a fourth speaker unit 24E, a fifth speaker unit 25E, and an ear plug sleeve 30E.

Referring to FIGS. 19 to 22, the case includes a housing 10E and a cover 11E. A sound guiding portion 13E is disposed on a side face of the housing 10E. An accommodating structure 16E is disposed at a middle portion of an inside of the sound guiding portion 13E. A front end of the accommodating structure 16E protrudes from a front end of the sound guiding portion 13E. The inside of the sound guiding portion 13E includes a left chamber 131E located at a left side of the accommodating structure 16E, a right chamber 132E located at a right side of the accommodating structure 16E, an upper chamber 133E located at an upper side of the accommodating structure 16E, and a lower chamber 134E located at a lower side of the accommodating structure 16E. The first speaker 21E is arranged in the accommodating structure 16E which is in front of the sound guiding portion 13E. The sound output direction of the first speaker 21E is the same as the sound output direction of the sound guiding portion 13E. The second speaker unit 22E is arranged in the left chamber 131E, the third speaker unit 23E is arranged in the right chamber 132E, the fourth speaker unit 24E is arranged in the upper chamber 133E, and the fifth speaker unit 25E is arranged in the lower chamber 134E.

A front end of the accommodating structure 16E has a sound output hole 17E, a front end of the left chamber 131E has a sound output hole 151E, a front end of the right chamber 132E has a sound output hole 152E, a front end of the upper chamber 133E has a sound output hole 153E, and a front end of the lower chamber 134E has a sound output hole 154E. The sound output holes 151E, 152E, 153E, and 154E are located at an end face of the sound guiding portion 13E away from the housing 10E. The sound waves generated by the first speaker unit 21E directly pass through the sound output hole 17E of the accommodating structure 16E, the sound waves generated by the second speaker unit 22E directly pass through the sound output hole 151E of the left chamber 131E, the sound waves generated by the third speaker unit 23E directly pass through the sound output hole 152E of the right chamber 132E, the sound waves generated by the fourth speaker unit 24E directly pass through the sound output hole 153E of the upper chamber 133E, and the sound waves generated by the fifth speaker unit 25E directly pass through the sound output hole 154E of the lower chamber 134E.

The ear plug sleeve 30E is sleeved on the sound guiding portion 13E, and the ear plug sleeve 30E is an elastic rubber body. The ear plug sleeve 30E has a plurality of openings (not labeled) corresponding to the positions of the sound output hole 151E, the sound output hole 152E, the sound output hole 153E, the sound output hole 154E, and the sound output hole 17E.

The first speaker unit 21E, the second speaker unit 22E, the third speaker unit 23E, the fourth speaker unit 24E, and the fifth speaker unit 25E are balanced armature speaker units.

According to the sixth embodiment, in use, the front end of the housing 10E is disposed at the outer ear of the user and is oriented towards the ear canal of the user. The sound output hole 17E of the accommodating structure 16E is oriented directly towards the ear canal, and the sound output holes 151E, 152E, 153E, and 154E are also oriented toward the ear canal. The sound waves generated by the second speaker unit 22E directly pass through the sound output hole 151E, the sound waves generated by the third speaker unit 23E directly pass through the sound output hole 152E, the sound waves generated by the fourth speaker unit 24E directly pass through the sound output hole 153E, and the sound waves generated by the fifth speaker unit 25E directly pass through the sound output hole of the lower chamber 134E. The sound waves generated by the first speaker unit 21E are directly transmitted to the inside of the ear of the user through the sound output hole 17E of the accommodating structure 16E. Since the sound output hole 17E is closer to the ear canal of the user than the sound output holes 151E, 152E, 153E, and 154E, the earphone of the present embodiment enables the user to hear a clear sound. Moreover, the sound waves outputted from the sound output holes 151E, 152E, 153E, and 154E are mixed to create a stereo sound field. In combination with the above two kinds of sounds, the earphone of the present embodiment provides a clearer auditory experience and the stereo sound field effect to the user at the same time.

Figure 23:
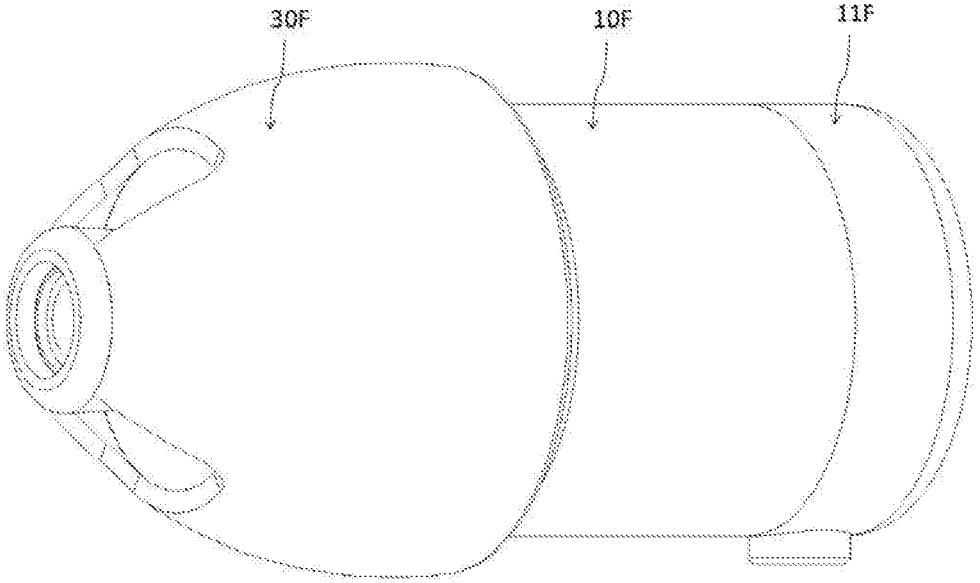
FIG. 23 is a perspective view showing an earphone according to a seventh embodiment of the present disclosure.
Figure 24:
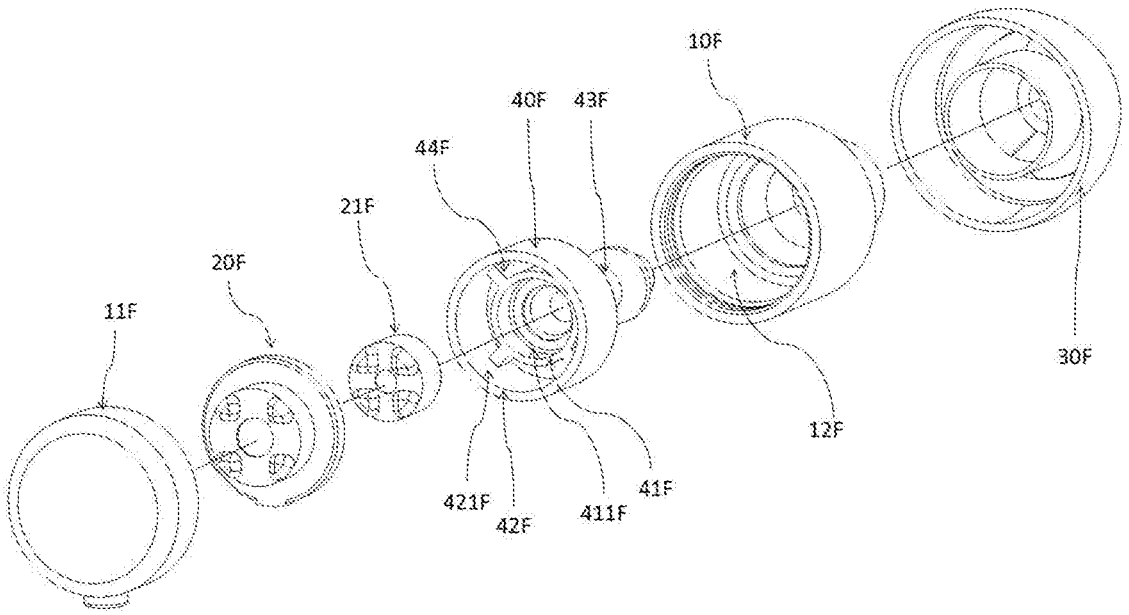
FIG. 24 is an exploded view of FIG. 23.

Referring to FIG. 23 and FIG. 24, which is a seventh embodiment of the present disclosure, the present embodiment discloses an earplug type earphone including a case, a bracket 40F, a first speaker unit 20F, a second speaker unit 21F, and an ear plug sleeve 30F.

Figure 25:
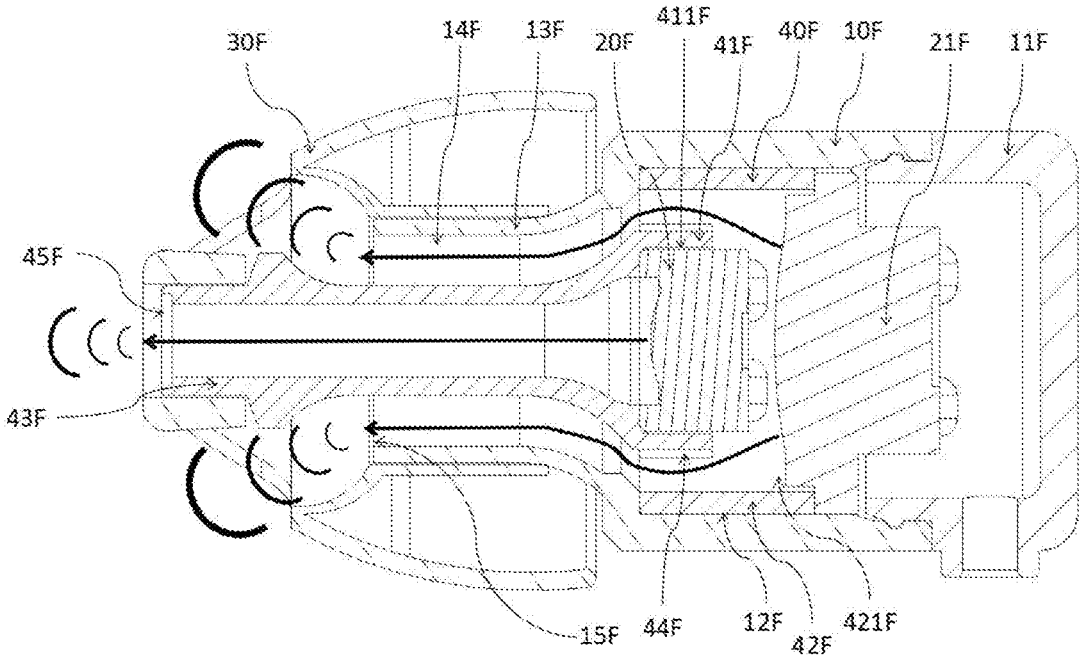
FIG. 25 is a cross-sectional view of FIG. 23.

Referring to FIG. 24 and FIG. 25, the case includes a housing 10F and a cover 11F. The housing 10F includes a chamber 12F, and a sound guiding portion 13F is disposed on a side face of the housing 10F. The bracket 40F is disposed in the chamber 12F of the housing 10F. The bracket 40F includes a sound guiding tube 43F, a first cylinder 41F, a second cylinder 42F, and a connecting portion 44F. The first cylinder 41F is connected to the sound guiding tube 43F. The first cylinder 41F has a first accommodation space 411F. The sound guiding tube 43F passes through the sound guiding portion 13F such that an outer sound guiding channel 14F is formed between the sound guiding tube 43F and the sound guiding portion 13F. The second cylinder 42F is separated from the first cylinder 41F, and the first cylinder 41F is located in the second cylinder 42F. The connecting portion 44F is configured to connect the first cylinder 41F and the second cylinder 42F. The second cylinder 42F has a second accommodation space 421F, and the second accommodation space 421F is in spatial communication with the outer sound guiding channel 14F through a gap between the first cylinder 41F and the second cylinder 42F. The first speaker unit 20F is arranged in the first accommodation space 411F, and the second speaker unit 21F is arranged in the second accommodation space 421F.

The outer sound guiding channel 14F has a sound output hole 15F which is in a ring shape. The sound guiding tube 43F of the bracket 40F has a sound output hole 45F protruding from the sound guiding portion 13F. The sound output of the sound output hole 15F and the sound output hole 45F are oriented toward the direction that the outer sound guiding channel 14F extends. The sound waves generated by the first speaker unit 20F directly pass through the sound output hole 45F of the sound guiding tube 43F. The sound waves generated by the second speaker unit 21F pass through the gap between the first cylinder 41F and the second cylinder 42F, and directly pass through the sound output hole 15F of the outer sound guiding channel 14F.

The ear plug sleeve 30F is sleeved on the sound guiding portion 13F, and the ear plug sleeve 30F is an elastic rubber body.

According to the seventh embodiment, in use, the front end of the housing 10F is disposed at the outer ear of the user and is oriented towards the ear canal of the user. The sound output hole 45F of the sound guiding tube 43F is oriented directly towards the ear canal, and the sound output hole 15F of the outer sound guiding channel 14F is also oriented toward the ear canal. The sound waves generated by the first speaker unit 20F are transmitted to the inside of the ear of the user through the sound output hole 45F of the sound guiding tube 43F. The sound waves generated by the second speaker unit 21F pass through the gap between the first cylinder 41F and the second cylinder 42F, and directly pass through the sound output hole 15F of the sound guiding portion 13F. Since the sound output hole 45F is closer to the ear canal of the user than the sound output hole 15F, the earphone of the present embodiment enables the user to hear a clear sound. Moreover, the sound waves outputted from the sound output hole 15F are diffused to create a sound field. In combination with the above two kinds of sounds, the earphone of the present embodiment provides a clearer auditory experience and the sound field effect to the user at the same time.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An earphone, comprising: a housing; wherein a sound guiding portion is disposed on the housing, at least one speaker unit is arranged in the housing, and a sound guiding tube is disposed in the sound guiding portion such that an inner sound guiding channel and an outer sound guiding channel are formed in the sound guiding portion; wherein the outer sound guiding channel is located between the sound guiding portion and the sound guiding tube in a radial direction of the sound guiding tube and is divided into at least one sound guiding channel; wherein the sound guiding portion has at least one sound output hole of the inner sound guiding channel and at least one sound output hole of the outer sound guiding channel, and all the sound output holes are oriented in the same direction that the sound guiding portion extends; wherein the sound output hole of the inner sound guiding channel protrudes from the sound output hole of the outer sound guiding channel such that the sound output hole of the inner sound guiding channel is farther from the housing than the sound output hole of the outer sound guiding channel, so that the at least one sound output hole of the outer sound guiding channel is located between the at least one sound output hole of the inner sound guiding channel and the at least one speaker unit in an axial direction of the at least one sound output hole of the inner sound guiding channel; wherein the sound waves in the inner sound guiding channel directly pass through the sound output hole of the inner sound guiding channel, and the sound waves in the outer sound guiding channel directly pass through the sound output hole of the outer sound guiding channel;

wherein an outer wall of the sound guiding tube has a ring-shaped inclined surface close to the sound output holes, the inclined surface is in front of the sound output hole of the outer sound guiding channel and is close to the sound output hole of the inner sound guiding channel; wherein the inclined surface covers a part of the sound output direction of the sound output hole of the outer sound guiding channel such that a part of the sound waves outputted from the sound output hole of the outer sound guiding channel are directly outputted, and another part of the sound waves outputted from the sound output hole of the outer sound guiding channel are refracted by the inclined surface.

2. An earphone, comprising: a housing, a first speaker unit, and a second speaker unit; wherein a sound guiding portion is disposed on the housing, and at least one sound guiding channel and an accommodating structure capable of accommodating the second speaker unit are respectively disposed in the sound guiding portion; wherein the sound guiding channel is located between the accommodating structure and an outer wall of the sound guiding portion, and a sound output hole of the sound guiding channel is located at an end face of the sound guiding portion away from the housing; wherein the accommodating structure partially protrudes from the sound output hole of the sound guiding channel, and a front end of the accommodating structure has a sound output hole; wherein the first speaker unit is arranged in the housing, and the second speaker unit is arranged in the accommodating structure; wherein the sound output direction of the second speaker unit is the same as the sound output direction of the sound guiding portion; wherein the sound waves generated by the first speaker unit directly pass through the sound output hole of the sound guiding channel, and the sound waves generated by the second speaker unit directly pass through the sound output hole of the accommodating structure;

wherein an outer wall of the accommodating structure has a ring-shaped inclined surface close to the sound output holes, the inclined surface is in front of the sound output hole of the sound guiding channel and is close to the sound output hole of the accommodating structure; wherein the inclined surface covers a part of the sound output direction of the sound output hole of the sound guiding channel such that a part of the sound waves outputted from the sound output hole of the sound guiding channel are directly outputted, and another part of the sound waves outputted from the sound output hole of the sound guiding channel are refracted by the inclined surface.

3. An earphone, comprising: a housing, a first speaker unit, a second speaker unit, a third speaker unit, a fourth speaker unit, and an ear plug sleeve; wherein a tubular sound guiding portion is disposed on the housing, an accommodating structure is located at a front end of the sound guiding portion, and a front end of the accommodating structure protrudes from an end face of the sound guiding portion; wherein the first speaker unit is arranged in the housing, and the second speaker unit is arranged in the accommodating structure located at the front end of the sound guiding portion; wherein the sound output direction of the second speaker unit is the same as the sound output direction of the sound guiding portion; wherein an inside of the sound guiding portion includes a left chamber located at a left side of the accommodating structure, and includes a right chamber located at a right side of the accommodating structure; wherein the third speaker unit is arranged in the left chamber, and the fourth speaker unit is arranged in the right chamber; wherein the inside of the sound guiding portion is divided into an upper sound guiding channel and a lower sound guiding channel by the accommodating structure, the left chamber, and the right chamber; wherein the upper sound guiding channel and the lower sound guiding channel each has a sound output hole located at an end face of the sound guiding portion away from the housing; wherein a front end of the accommodating structure has a sound output hole, a front end of the left chamber has a sound output hole, and a front end of the right chamber has a sound output hole; wherein the sound waves generated by the first speaker unit are directly and respectively outputted from the sound output holes of the upper sound guiding channel and the lower sound guiding channel, the sound waves generated by the second speaker unit directly pass through the sound output hole of the accommodating structure, the sound waves generated by the third speaker unit directly pass through the sound output hole of the left chamber, and the sound waves generated by the fourth speaker unit directly pass through the sound output hole of the right chamber.

4. An earphone, comprising: a housing, a first speaker unit, a second speaker unit, a third speaker unit, a fourth speaker unit, a fifth speaker unit, and an ear plug sleeve; wherein a tubular sound guiding portion is disposed on the housing, an accommodating structure is located at a front end of the sound guiding portion, and a front end of the accommodating structure protrudes from an end face of the sound guiding portion; wherein the first speaker unit is arranged in the accommodating structure, the sound output direction of the first speaker unit is the same as the sound output direction of the sound guiding portion; wherein an inside of the sound guiding portion includes a left chamber located at a left side of the accommodating structure, a right chamber located at a right side of the accommodating structure, an upper chamber located at an upper side of the accommodating structure, and a lower chamber located at a lower side of the accommodating structure; wherein the second speaker unit is arranged in the left chamber, the third speaker unit is arranged in the right chamber, the fourth speaker unit is arranged in the upper chamber, and the fifth speaker unit is arranged in the lower chamber; wherein a front end of the accommodating structure has a sound output hole, a front end of the left chamber has a sound output hole, a front end of the right chamber has a sound output hole, a front end of the upper chamber has a sound output hole, and a front end of the lower chamber has a sound output hole; wherein the sound output hole of the left chamber, the sound output hole of the right chamber, the sound output hole of the upper chamber, and the sound output hole of the lower chamber are located at an end face of the sound guiding portion away from the housing; wherein the sound waves generated by the first speaker unit directly pass through the sound output hole of the accommodating structure, the sound waves generated by the second speaker unit directly pass through the sound output hole of the left chamber, the sound waves generated by the third speaker unit directly pass through the sound output hole of the right chamber, the sound waves generated by the fourth speaker unit directly pass through the sound output hole of the upper chamber, and the sound waves generated by the fifth speaker unit directly pass through the sound output hole of the lower chamber.

* * * * *